US008152376B2

(12) United States Patent
Rosentreter

(10) Patent No.: US 8,152,376 B2
(45) Date of Patent: Apr. 10, 2012

(54) PACKAGE HAVING A TEAR INITIATION FOR FORMING AN OPENING

(75) Inventor: Antje Rosentreter, Wuppertal (DE)

(73) Assignee: Stora Enso OYJ, Helsinki (FI)

( * ) Notice: Subject to any disclaimer, the term of this patent is extended or adjusted under 35 U.S.C. 154(b) by 837 days.

(21) Appl. No.: 12/096,131

(22) PCT Filed: Dec. 21, 2006

(86) PCT No.: PCT/EP2006/070088

§ 371 (c)(1),
(2), (4) Date: Jul. 18, 2008

(87) PCT Pub. No.: WO2007/071764

PCT Pub. Date: Jun. 28, 2007

(65) Prior Publication Data

US 2008/0279488 A1 Nov. 13, 2008

(30) Foreign Application Priority Data

Dec. 21, 2005 (EP) ..... 05445095

(51) Int. Cl.
*B65D 33/00* (2006.01)

(52) U.S. Cl. ..... 383/207; 229/243

(58) Field of Classification Search ..... 383/207, 383/200, 203; 229/106, 930, 244, 243, 123.3
See application file for complete search history.

(56) References Cited

U.S. PATENT DOCUMENTS

| | | | | |
|---|---|---|---|---|
| 2,002,364 | A | 5/1935 | Daller | |
| 2,360,439 | A | 10/1944 | Monroe | |
| 2,415,869 | A * | 2/1947 | Coleman | 229/135 |
| 3,324,998 | A | 6/1967 | Farquhar | |
| 4,410,128 | A | 10/1983 | Rausing | |
| 4,655,387 | A | 4/1987 | Magnusson | |
| 5,018,625 | A * | 5/1991 | Focke et al. | 229/87.05 |
| 5,803,349 | A * | 9/1998 | Ljungstrom | 229/137 |
| 6,929,171 | B1 * | 8/2005 | Thiersch | 229/125.15 |
| D609,088 | S * | 2/2010 | Kvam | D9/431 |

* cited by examiner

*Primary Examiner* — Nathan J Newhouse
*Assistant Examiner* — Christopher Demeree
(74) *Attorney, Agent, or Firm* — Greer, Burns & Crain, Ltd.

(57) ABSTRACT

A package having a tear initiation (60) for forming an opening (71, 72), the tear initiation (60) extending 5 from a first panel (10) to a corner edge (11) being in common with the first panel (10) and a second panel (20), the tear initiation (60) further extending along the corner edge (11), from the corner edge (11) to the second panel (20) and back from the second panel (20) to the 10 corner edge (11), along the corner edge (11), and from the corner edge (11) onto the first panel (10), wherein the first panel (10) at the corner edge (11) has a convex curvature outwardly of the package and at the corner edge (11) the second panel (20) has a concave curvature 15 inwardly of the package, wherein two inclined fold lines (81, 82) on mutually opposing sides of the second portion, each extending from the tear initiation (60*g*) defining the second portion (72) to the corner edge (11), define two flap portions (91, 92) at the corner edge 20 (11).

10 Claims, 5 Drawing Sheets

PACKAGE HAVING A TEAR INITIATION FOR FORMING AN OPENING

CROSS-REFERENCE

This application is a Section 371 national stage of International Application No. PCT/EP2006/070088 filed Dec. 21, 2006, which claims priority from European Application No. 05445095.2 filed Dec. 21, 2005.

FIELD OF INVENTION

The present invention relates to a package having a tear initiation for forming an opening. It is contemplated to use the package for wet or dry pourable food products, such as juice, milk, wine, tomato sauce, cornflakes or the like, and the basic design concept of the package is therefore adapted to make this contemplated use possible. The package may be used for other kinds of goods.

BACKGROUND ART

U.S. Pat. No. 4,410,128 discloses a parallelepipedic package for milk, juice or the like. The packaging material is supplied in the form of a web. The package is formed from the packaging material by folding the web to a tube by joining together the longitudinal edges of the web. The tube is thereafter filled with the intended contents and divided up in separate liquid containing units by providing narrow transverse sealing zones situated at a distance from each other along the tube. These transverse sealing zones will form a so-called sealing fin at the top and at the bottom of the final package. After the transversal sealing the packages are separated by cuts in the transverse sealing zones. Finally the package is formed to the final shape by folding. The additional material at the top and bottom of the package forms triangular lugs or flaps. At the bottom of the package the sealing fin is flat-laid along the bottom and the lugs are folded down under the bottom. At the top of the package the lugs are folded down along two opposing side surfaces and the sealing fin is thereby held in a flat laid position along the top of the package.

The above discussed package is provided with a tear-up opening arrangement, wherein the packaging material is pierced through along a perforated cut line which is situated alongside a base line of the sealing fin at the top of the package. The cut line is covered along the inside of the package by a thin plastic strip. The package is opened by lifting the lug from the side surface of the package and cutting or tearing along the perforated cut line. Once opened this kind of package offers no reclosability and must therefore be handled carefully to prevent spillage until all of the content has been consumed.

U.S. Pat. No. 4,655,387 discloses a similar package manufactured in the same manner as the one disclosed in U.S. Pat. No. 4,410,128. U.S. Pat. No. 4,655,387 discloses however a different kind of opening arrangement. At the centre portion the perforation is formed along curved line. Since the perforation is folded at the centre with the perforation lines extending in parallel along the sealing fin it has been found that problems might occur with undesired tear propagation. The curved centre portion is said to avoid this kind of problems.

Also this package is opened by lifting the lug from the side surface of the package and tearing along the perforated line. Once opened this kind of package offers no reclosability and must therefore be handled carefully to prevent spillage until all of the content has been consumed.

Thus, the known packages suffers from the drawback that the offer no reclosability.

Moreover, the openings offered by the tear openings or the prior art are only relatively small openings.

SUMMARY OF THE INVENTION

An object of the invention is to provide a package having a tear initiation for forming an opening, wherein the package and its opening has a reclosability feature.

Another object of the invention is to provide a package concept which is adapted to provide a an opening being relatively large in relation to the size of the package.

The above objects have been achieved by a package having a tear initiation for forming an opening, wherein the tear initiation extends from a first location on a first panel of the package to a corner edge being in common with the first panel and a second panel of the package, the tear initiation further extending a first distance along the corner edge, from the corner edge to the second panel and back from the second panel to the corner edge, a second distance along the corner edge, and from the corner edge to a second location on the first panel, the tear initiation defining a first portion of the opening on the first panel and a second portion of the opening on the second panel, wherein the first portion has a first extension along the corner edge and the second portion has a second extension along the corner edge, the first extension being greater than the second extension, wherein the package is formed such that at the corner edge the first panel has a convex curvature outwardly of the package and at the corner edge the second panel has a concave curvature inwardly of the package, wherein a first inclined fold line extends from the tear initiation defining the second portion to the corner edge, and wherein a second inclined fold line, on the opposite side of the second portion, extends from the tear line defining the second portion to the corner edge, whereby two flap portions are defined and each being located on mutually opposing sides of the second portion on the second panel in conjunction with the fold line.

The opening formed in this manner is to be opened by the user gripping the corner edge formed by the first and second portions where the first and second portion of the opening extends across the corner edge between the first and the second panel. The first and second portion will flex slightly inwardly towards each other until the tear line breaks and the second portion is released from the second panel. Thereafter the portion of the first panel located between the tear-line portions on the first panel is pulled upwards. Alternatively, the user may initially push the second portion of the tear-open opening inwardly, thus releasing the second portion from the second panel before the remaining first portion of the opening is torn open by gripping the edge where the second portion is refolded underneath and in planar abutment with the first portion. If the second portion is initially pushed into the package, the width to grip will thus only be the combined material thickness of the first and second panels. When the user has poured the desired amount of the product out of the package, the user may fold the flaps slightly inwardly. The flaps on both sides of the second portion is released when the opening is torn open and may be folded inwardly. The torn open area produced by the first and second portion may then be snapped behind the flaps and is thereby held in its closed position.

Since the tear initiation extends from a first location on a first panel of the package to a corner edge being in common with the first panel and a second panel of the package, and further extends a first distance along the corner edge, from the corner edge to the second panel and back from the second panel to the corner edge, a second distance along the corner edge, and from the corner edge to a second location on the first panel, it is possible to form an opening on the first panel which may occupy essentially the whole surface area of the first panel. The extension of the tear initiation on the second panel offers a possibility to provide a specifically designed initial breaking of the tearing action, and it is relatively easy to grip the packaging material at the corner edge (or edge formed by initial breaking of the second portion) by a pinching action.

By designing the tear initiation such that the first portion has a first extension along the corner edge and the second portion has a second extension along the corner edge, wherein the first extension being greater than the second extension, the initial break is facilitated by limiting the total tear initiation extension to be broken at the initial tearing action. Once the tearing action has begun the tearing motion will relatively easily follow the tear initiation similarly to a crack propagation. The difference in extension along the corner edge also offers the possibility to provide the with flaps offering a reclosability feature. In the preferred embodiment the flaps are part of the package wall before the package is opened and the free edges of the flaps are automatically freed when the opening is torn open.

By providing the package with a first inclined fold line extends from the tear initiation defining the second portion to the corner edge, and wherein a second inclined fold line, on the opposite side of the second portion, extends from the tear line defining the second portion to the corner edge, two flap portions are defined, each being located on mutually opposing sides of the second portion on the second panel in conjunction with the corner edge. When the opening is torn open the flaps are automatically formed and the user may fold them inwardly about the fold lines and thereby achieve locking flaps, whereby a reclosability feature is provided.

By forming the package is formed such that the first panel at the corner edge has a convex curvature outwardly of the package, the thus formed flaps will in their unaffected condition have a corner extending upwardly and when folding inwardly the corner will extend distinctly inwardly, thus forming a distinct locking feature.

Moreover, since the package is formed such that the second panel at the corner edge has a concave curvature inwardly of the package, the thus formed flaps will be given a snap-over effect which will give the flaps a tendency to be kept in an inwardly folded or outwardly folded condition. The straight crease line will be slightly curved with the curvature of the second panel and the straight distance from end to end of the crease line will be slightly shorter than the flat laid length of the crease line. Thus, when folded inwardly the flaps will stay folded inwardly, which in turn will make the locking feature even stronger.

Preferred embodiments follow from the dependent claims.

A first and a second portion of the tear initiation defining the first portion of the opening may extend on the first panel from the corner edge essentially rectilinear to the corner edge. This way the tear initiation will follow a natural movement of the user and it will be easy to open the package irrespective of if the user is left or right handed.

A first and a second portion of the tear initiation defining the first portion of the opening may each have an end located at a distance from the corner edge, wherein a fold line may be formed between said ends. Thereby the tearing action will have a natural end position. The end portions of the fold line may be used to form natural stopping means preventing further tearing. The first portion of the opening will open like a flap about the fold line. The fold line may be a crease line or some other local difference in bending resistance facilitating and focusing the bending of the panel such that is it limited to a line.

A portion of the tear initiation defining the second portion of the opening may extend along a curved or broken line connecting to the corner edge at both its ends whereby the second portion will be removed from the second panel and be remain connected to the first portion when the opening is torn open. The curved or broken line will provide an area delimited from the second panel, thus providing an initial break area and a grip portion facilitating the tearing of the first portion. The curved line may e.g. be formed as a half circle or a half circle provided with tangential extensions rectilinear to the corner edge. It may also be formed as less than a half circle. The broken line may e.g. be formed as mansard roof turned upside down.

A rear wall of the package has a length from a bottom of the package to the first panel, and a front wall, at least partly formed of the second panel, of the package has a length from the bottom of the package to the first panel, wherein the length of the rear wall may be greater than the length of the front wall. Thereby a slanted top panel is formed. The slanted top panel will give an increase of the available surface area for the opening.

The package may be formed of a paper-based laminated packaging material provided with an impermeable polymer-based material layer on at least an inside of the package. Thereby the package may be used for storing liquid food products. Depending on the application the degree of impermeability may vary. For chilled distribution and temperature insensitive products it may be enough with liquid impermeability. For some applications it will be necessary with gas impermeability in order to prevent loss of taste or reaction of the product with e.g. oxygen. For yet other applications the package might need to the completed with a barrier (usually of aluminium) in order to make it possible to keep the package tight enough for distribution of so-called ultra high temperature treated food products without the need for any chilled distribution.

The polymer-based material layer may be heat sealable which will facilitate the closing and forming of the package.

The tear initiation may be formed of a perforation extending along said tear line. This offers a simple solution which still gives a distinct tear action.

An uppermost portion of a rear wall may be formed with a curvature corresponding to the curvature of the corner edge being in common with the first and second panels such that the rear wall of a package will fit to a front wall of an adjacent package. This will increase the use of available space when transported and it will help prevent the packages from falling over when transported on a conveyor or the like. Any difference in inclination of abutting surfaces has, in a queue of abutting packages, a tendency to build up to an inclination of the package itself and finally the package may fall over and cause a down time of the production facility.

BRIEF DESCRIPTION OF DRAWINGS

The invention will hereinafter be described by way of examples of presently preferred embodiments with reference to the appended schematic drawings.

DETAILED DESCRIPTION OF PREFERRED EMBODIMENTS

Figure 1:
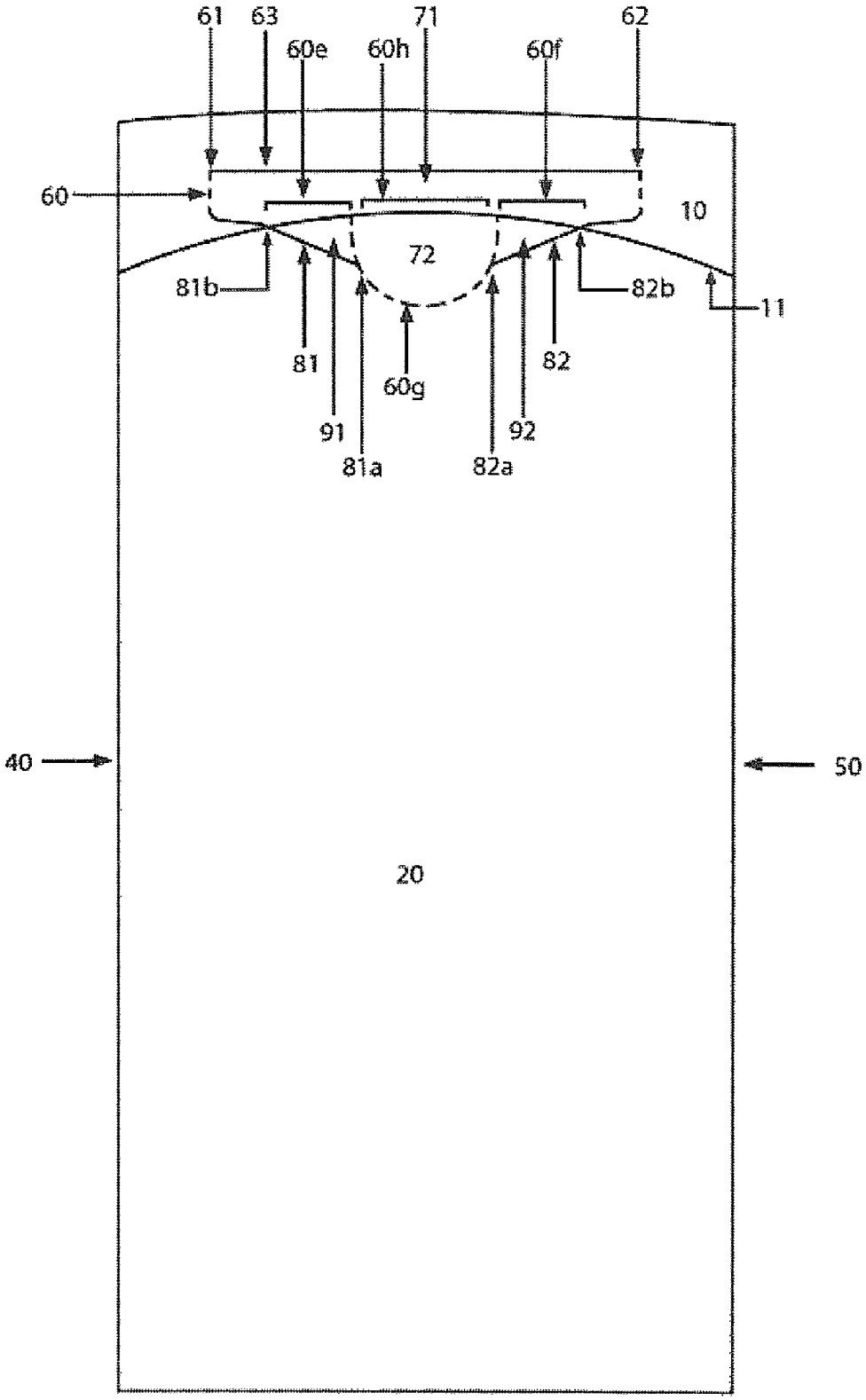
FIG. 1 is a plane view from the front of the package.

With reference to FIG. 1, the package has top panel 10 also denoted a first panel, a front panel 20 also denoted a second panel, a back panel 30 and two side panels 40 and 50.

The bottom may be formed in any suitable method available. There exists a number of different kinds of bottom folding methods of which many are well known in the art. The bottom forming method will therefore not be discussed in detail.

The package has further a tear initiation 60 for forming an opening. The tear initiation 60 is formed by a perforation. The tear initiation 60 extends from a first location 61 on the first panel 10 (top panel) to a corner edge 11 being in common with the top panel 10 and the front panel 20 (portions denoted 60*a* and 60*c*). The tear initiation 60 further extends a first distance 60*e* along the corner edge 11, from the corner edge 11 to the front panel 20 and back from the front panel 20 to the corner edge 11. The portion of the tear initiation 60 on the front panel is denoted 60*g*. The tear initiation 60 continues a second distance 60*f* along the corner edge 11, and from the corner edge 11 to a second location 62 on the top panel 10. The first and second locations 61, 62 are located a distance from the corner edge 11. The tear initiation 60 defines a first portion 71 of the opening on the top panel 10 and a second portion 72 of the opening on the front panel 20.

As shown especially in FIG. 1, the first portion 71 has a first extension 60*e*, 60*h*, 60*f* along the corner edge 11 and the second portion 72 has a second extension 60*h* along the corner edge 11, wherein the first extension 60*e*, 60*h*, 60*f* is greater than the second extension 60*h*. It may in this respect be noted that both the first and second portions 71, 72 has an extension along the distance denoted 60*h*, whereas the first portion 71 extends in both directions away from the second portion 72 along the corner edge 11.

Figure 2:
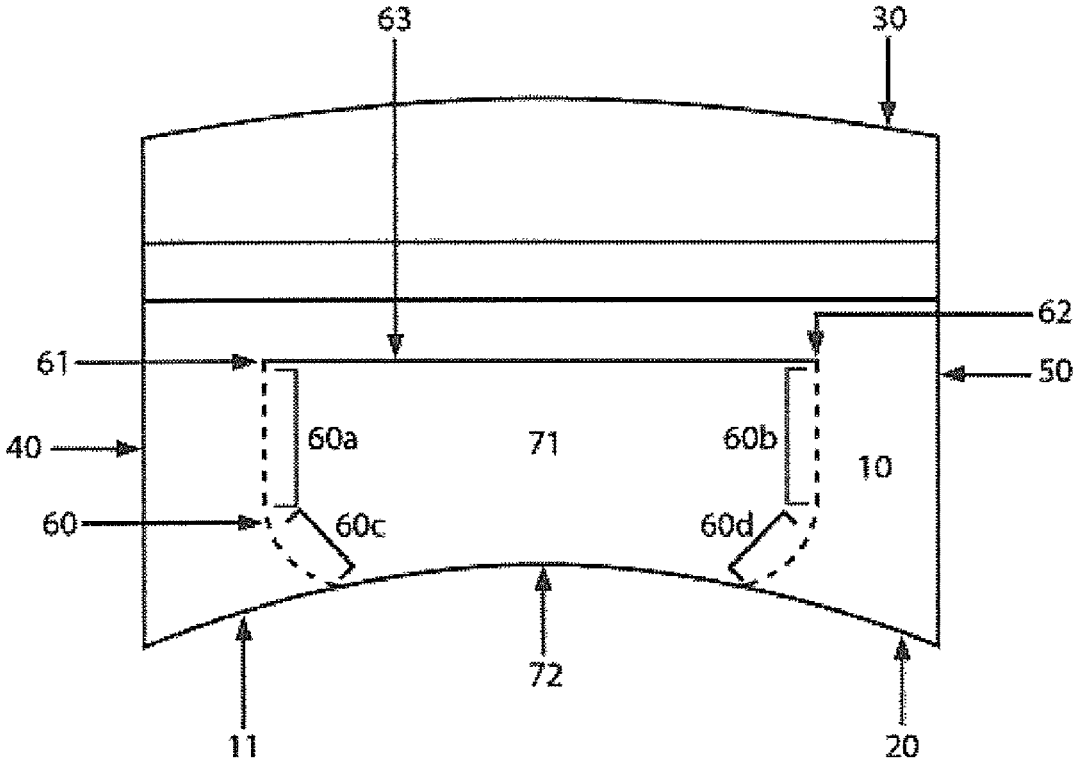
FIG. 2 is a plane view from above of the package.
Figure 3:
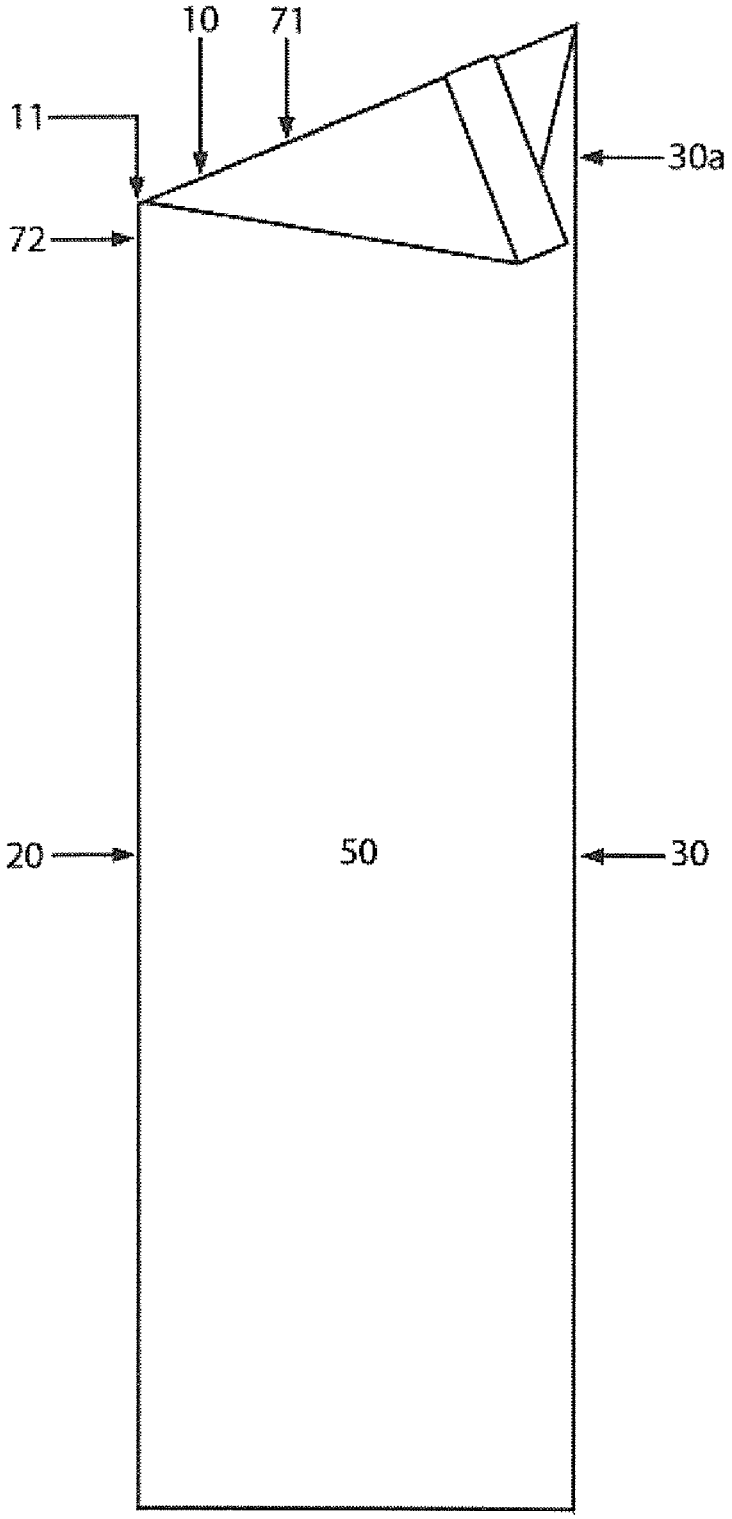
FIG. 3 is a plane view from the side of the package.
Figure 4:
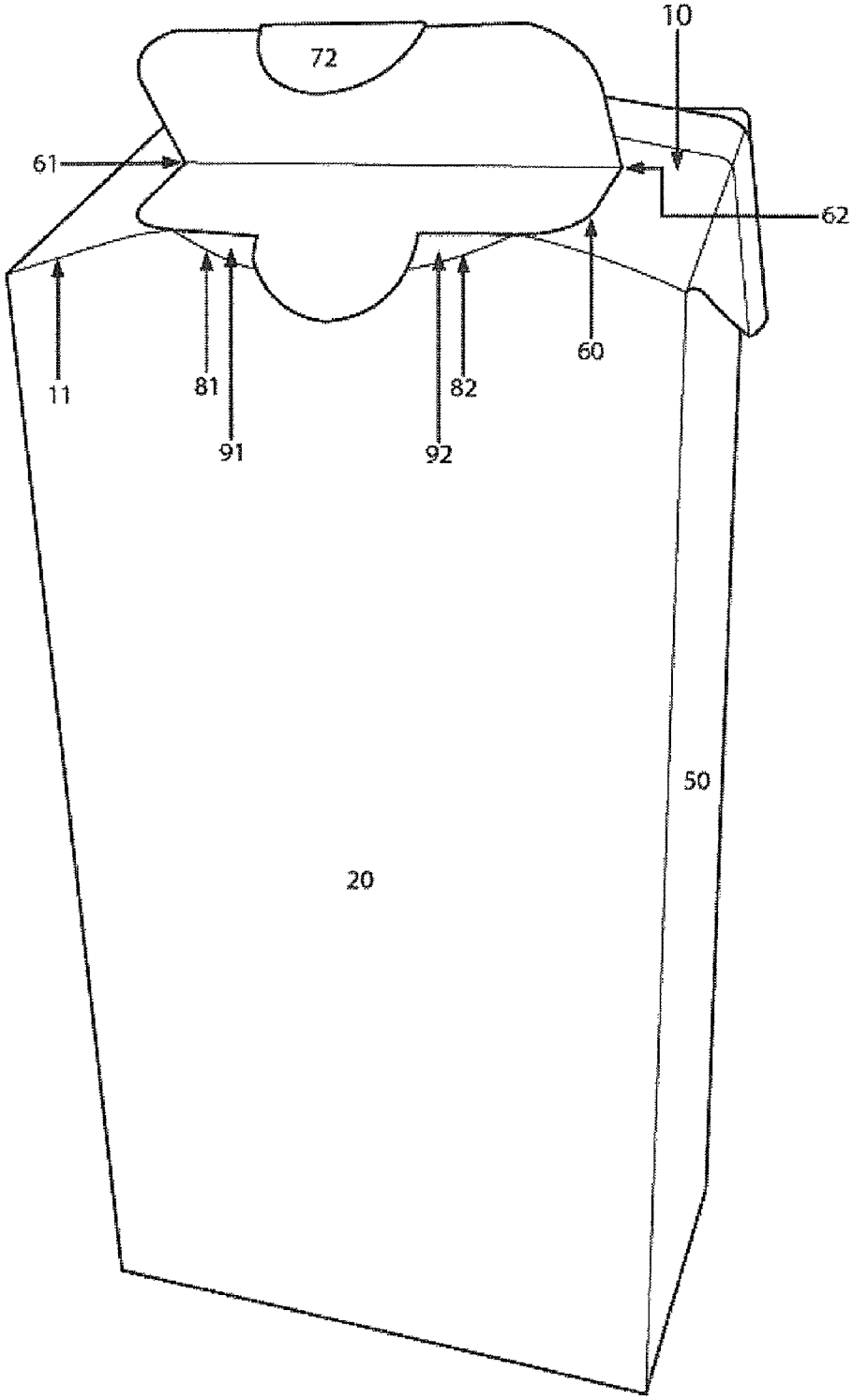
FIG. 4 is a view in perspective from above showing the package where the opening has been completely torn open.
Figure 5:
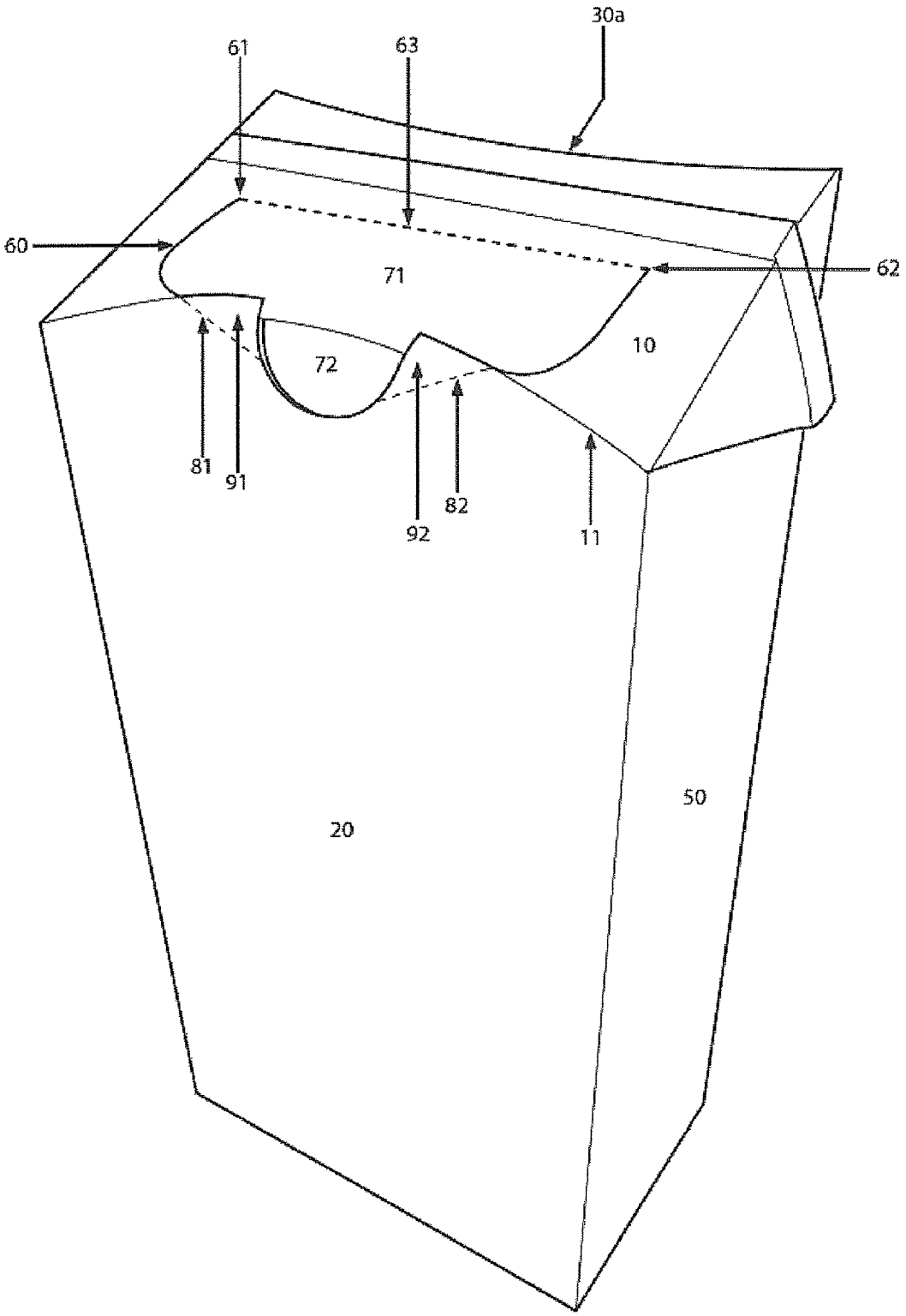
FIG. 5 is a view in perspective from above showing the package where the opening has of FIG. 4 has been reclosed and the locking flaps keep the opening reclosed.

As shown in FIG. 1, FIG. 4, and FIG. 5, the package is formed such that the top panel 10 at the corner edge 11 has a convex curvature outwardly of the package. As shown in FIG. 2 and FIG. 5, the package is further formed such that the front panel 20 at the corner edge 11 has a concave curvature inwardly of the package.

As shown in FIG. 1, FIG. 4 and FIG. 5, a first inclined fold line 81 extends from the tear initiation 60*g* defining the second portion 72 to the corner edge 11, and a second inclined fold line 82, on the opposite side of the second portion 72, extends from the tear line 60*g* defining the second portion to the corner edge 11, whereby two flap portions 91, 92 are defined and each being located on mutually opposing sides of the second portion 72 on the front panel in conjunction with the corner edge 11.

The first inclined fold line 81 extends from a point 81*a* located on the tear initiation 60*g* defining the second portion 72 and at a distance form the corner edge 11 to a point 81*b* located on the corner edge 11 and at a distance from the second portion 72. The second inclined fold line 82 extends from a point 82*a* located on the tear initiation 60*g* defining the second portion 72 and at a distance from the corner edge 11, the point 82*a* being opposite the corresponding point 81*a* of the first fold line 81 in relation to the second portion 72, to a point 82*b* located on the corner edge 11 and at a distance from the second portion 72, in a direction opposite the corresponding point 81*b* of the first fold line 81 in relation to the second portion 72.

As shown in FIG. 2, a first 60*a* and a second 60*b* portion of the tear initiation 60 defining the first portion 71 of the opening extends on the top panel 10 from the corner edge 11 essentially rectilinear to the corner edge 11. It may also be noted that at the transition from the first and second portions 60*a*, 60*b* of the tear initiation to the portions 60*e*, 60*f* extending along the corner edge 11, the tear initiation 60 follows two curved lines 60*c*, 60*d* forming a smooth transition such that the crack propagation along the tear initiation 60 will be able to turn and run onto the top panel 10 from running along the corner edge 11.

As shown in FIG. 1, FIG. 2 and FIG. 5, a creased fold line 63 is formed between the ends 61, 62 of the portions 60*a*, 60*b* of the tear initiation 60 forming the first portion 71 on the top panel 10.

The portion 60*g* of the tear initiation 60 defining the second portion 72 on the front panel 20 extends along a half circular line connecting to the corner edge 11 at both its ends. As clearly shown in FIG. 4, the second portion 72 will be removed from the front panel 20 and remain connected to the first portion 71 when the opening is torn open.

The rear wall 30 of the package has a length from a bottom of the package to the top 10 panel being greater than the length of the front wall 20 from the bottom of the package to the top panel 10. Thereby the top panel 10 will be slanted forwards. This inclination will give rise to a larger surface area within the cross-sectional perimeters of the geometric tube in which the package is located.

The package is formed of a paper-based laminated packaging material provided with an impermeable polymer-based material layer on at least an inside of the package, wherein the polymer-based material layer is heat sealable.

The uppermost portion 30*a* of the rear wall 30 is formed with a curvature corresponding to the curvature of the corner edge 11 being in common with the top panel 10 and the front panel 20 such that the rear wall 30 of a package will fit to the front wall 20 of an adjacent package.

The opening formed in this manner is to be opened by the user gripping the corner edge formed by the first and second portions 71, 72 where they extends across the corner edge 11. When the user pinches the corner edge 11 at this junction, the first and second portions 71 and 72 will flex slightly inwardly towards each other until the tear initiation 60*g* breaks and the second portion 72 is released from the front panel 20. Thereafter the portion 71 of the top panel located between the tear initiation portions 60*a-d* on the top panel 10 is pulled upwards. The tear action will propagate along the corner edge 11 from the second portion 72 to the first portion 71 and thereafter the first portion 71 will begun to be released. Alternatively, the user may initially push the second portion 72 inwardly, thus releasing the second portion 72 from the front panel 20 before the remaining first portion 71 of the opening is torn open by gripping the edge where the second portion 72 is refolded underneath and in planar abutment with the first portion 71. If the second portion 72 is initially pushed into the package, the width to grip will thus only be the combined material thickness of the top and front panels 10, 20. When the user has poured the desired amount of the product out of the package, the user may fold the flaps 91, 92 slightly inwardly. The flaps 91, 92 on both sides of the second portion 72 is released when the opening is torn open and may be folded inwardly about the fold lines 81 and 82. The torn open area produced by the first and second portions 71, 72 may then be snapped behind the flaps 91, 92 and is thereby held in its closed position.

Since the package is shaped such that the front panel will have a concave curvature in the vicinity of the corner edge the flaps 91, 92 will have a snap-over effect which will keep them in an inwardly bent state. Each inclined fold line 81, 82 will be slightly curved with the curvature of the front panel 20 and the straight geometric distance from end to end 81*a*, 81*b*; 82*a*, 82*b* of respective fold line 81, 82 will be slightly shorter than the flat laid or actual length of the fold line 81, 82. Thus, the fold lines 81, 82 will have two stable positions; curved outwardly or curved inwardly. Thus, when folded inwardly the flaps will stay inwardly folded, which in turn will make the locking feature even stronger.

In summary it may be said that the package has a tear initiation 60 for forming an opening 71, 72, the tear initiation 60 extending from a first panel 10 to a corner edge 11 being in common with the first panel 10 and a second panel 20, the tear initiation 60 further extending along the corner edge 11, from the corner edge 11 to the second panel 20 and back from the second panel 20 to the corner edge 11, along the corner edge 11, and from the corner edge 11 onto the first panel 10, wherein the first panel 10 at the corner edge 11 has a convex curvature outwardly of the package and the second panel 20 at the corner edge 11 has a concave curvature inwardly of the package, wherein two inclined fold lines 81, 82 on mutually opposing sides of the second portion, each extending from the tear initiation 60*g* defining the second portion 72 to the corner edge 11, define two flap portions 91, 92 at the corner edge 11.

A person skilled in the art readily realises that several modifications and variations are possible within the scope of the invention. It may for example be noted that the portion 60*g* of the tear initiation 60 forming the second portion 72 on the front panel 20 may have other shapes. It may e.g. be formed using a curved line with different radiuses along the curvature, the centre may be located a distance from the corner edge being shorter or longer than the radius. It is however important that there is still a flap formed in the corner formed by the second portion 72 and the first portion 71 along the corner edge 11. The portion 60*g* may also be formed as a broken line, e.g. formed as a mansard roof turned upside down.

The invention claimed is:

1. A package comprising a tear initiation for forming an opening, the tear initiation extending from a first location on a first panel of the package to a corner edge being in common with the first panel and a second panel of the package, the tear initiation further extending a first distance along the corner edge, from the corner edge to the second panel and back from the second panel to the corner edge, a second distance along the corner edge, and from the corner edge to a second location on the first panel, the tear initiation defining a first portion of the opening on the first panel and a second portion of the opening on the second panel, the first and second portions being adjacent one another at the corner edge, the length of the first portion along the corner edge being greater than the length of the second portion along the corner edge, the first panel having a convex curvature outwardly of the package and at the corner edge, and the second panel having a concave curvature inwardly of the package at the corner edge, and a first inclined fold line on one side of the second portion extending from the tear initiation defining the second portion to the corner edge, and a second inclined fold line, on the opposite side of the second portion, extending from the tear initiation defining the second portion to the corner edge, whereby two flap portions are defined on the second panel between the fold lines and the tear initiation.

2. A package according to claim 1, wherein a first and a second portion of the tear initiation defining the first portion of the opening extends on the first panel from the corner edge essentially rectilinear to the corner edge.

3. A package according to claim 1, wherein a first and a second portion of the tear initiation defining the first portion of the opening each has an end located at a distance from the corner edge, wherein a fold line is formed between said ends.

4. A package according to claim 1, wherein a portion of the tear initiation defining the second portion of the opening extends along a curved or broken line connecting to the corner edge at both its ends whereby the second portion will be removed from the second panel and remain connected to the first portion when the opening is torn open.

5. A package according to claim 1, wherein a rear wall of the package has a length from a bottom of the package to the first panel, and a front wall, at least partly formed of the second panel, of the package has a length from the bottom of the package to the first panel, wherein the length of the rear wall is greater than the length of the front wall.

6. A package according to claim 1, wherein the package is formed of a paper-based laminated packaging material provided with an impermeable polymer-based material layer on at least an inside of the package.

7. A package according to claim 6, wherein the polymer-based material layer is heat sealable.

8. A package according to claim 1, wherein the tear initiation is formed of a perforation.

9. A package according to claim 1, wherein an uppermost portion of a rear wall may be formed with a curvature corresponding to the curvature of the corner edge being in common with the first and second panels such that the rear wall of a package will fit to a front wall of an adjacent package.

10. A package comprising a top panel, a side panel and a corner edge in common with the top panel and the side panel, the top panel being convex outwardly of the package at the corner edge and the side panel being concave inwardly of the package at the corner edge, a tear initiation for forming an opening, the tear initiation extending from a first location on the top panel to the corner edge, a first distance along the corner edge, from the corner edge to the second panel and back from the second panel to the corner edge, a second distance along the corner edge, and from the corner edge to a second location on the top panel, the tear initiation defining a first portion of the opening on the top panel and a second portion of the opening on the side panel, the first and second portions being adjacent one another at the corner edge, the length of the first portion along the corner edge being greater than the length of the second portion along the corner edge, and a first inclined fold line on the side panel on one side of the second portion extending from the tear initiation defining the second portion to the corner edge, and a second inclined fold line on the side panel, on the opposite side of the second portion, extending from the tear initiation defining the second portion to the corner edge, two flap portions being defined on the side panel between the fold lines and the tear initiation.

* * * * *